United States Patent [19]

Brouwer et al.

[11] 4,362,189

[45] Dec. 7, 1982

[54] FLUID WEFT INSERTION LOOM MONITORING SYSTEM

[75] Inventors: Charles W. Brouwer, East Greenwich, R.I.; Larry C. Cowan, York, S.C.

[73] Assignee: Leesona Corporation, Warwick, R.I.

[21] Appl. No.: 223,203

[22] Filed: Jan. 7, 1981

[51] Int. Cl.[3] ..... D03D 51/18

[52] U.S. Cl. ..... 139/336; 139/341; 139/370.2

[58] Field of Search ..... 139/336, 336.6, 341, 139/344, 349, 370.1, 370.2, 372, 435; 340/259; 66/163

[56] References Cited

U.S. PATENT DOCUMENTS

| | | | |
|---|---|---|---|
| 4,044,800 | 8/1977 | Germani | 139/341 |
| 4,072,935 | 2/1978 | Rydborn | 139/370.1 |
| 4,215,728 | 8/1980 | Weidman et al. | 139/370.2 |

FOREIGN PATENT DOCUMENTS

| | | | |
|---|---|---|---|
| 2067606 | 7/1981 | United Kingdom | 139/370.2 |
| 672241 | 7/1979 | U.S.S.R. | 139/370.2 |

*Primary Examiner*—Henry Jaudon

*Attorney, Agent, or Firm*—Burnett W. Norton

[57] ABSTRACT

A monitoring system for a fluid weft insertion loom monitors the significant operative events of each weaving cycle of the loom, e.g. yarn supply withdrawal, insertion nozzle actuation and yarn end arrival, and indicates the occurrence of each such event, preferably in terms of the elapsed time of such occurrence from a fixed reference point of the loom cycle, for example front dead center. The indications of the relative timing of the occurrences of such events is preferably retained on corresponding visual displays until the successful completion of each weaving cycle or in the event of a defective cycle until the defect is corrected and the loom is restarted. Preferred individual sensing units for the respective significant operative events are also disclosed.

8 Claims, 20 Drawing Figures

FIG. 2.
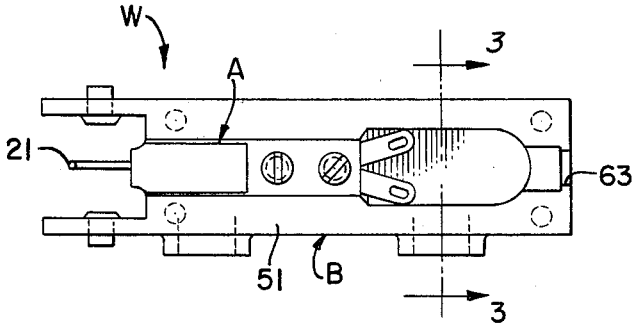
FIG. 3.
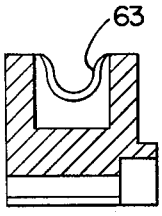
FIG. 4.
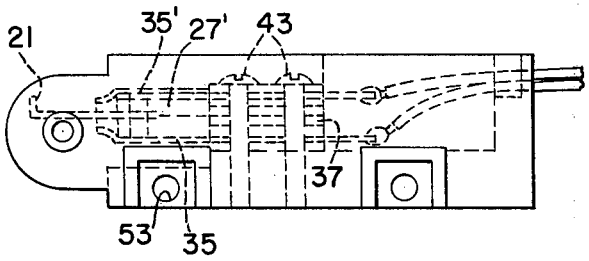
FIG. 5.
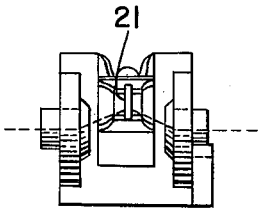
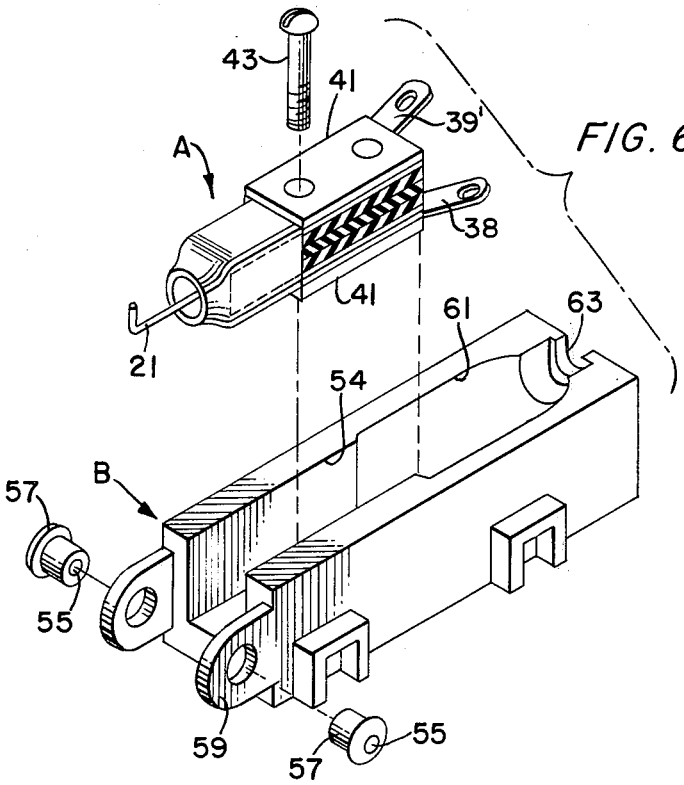
FIG. 6.

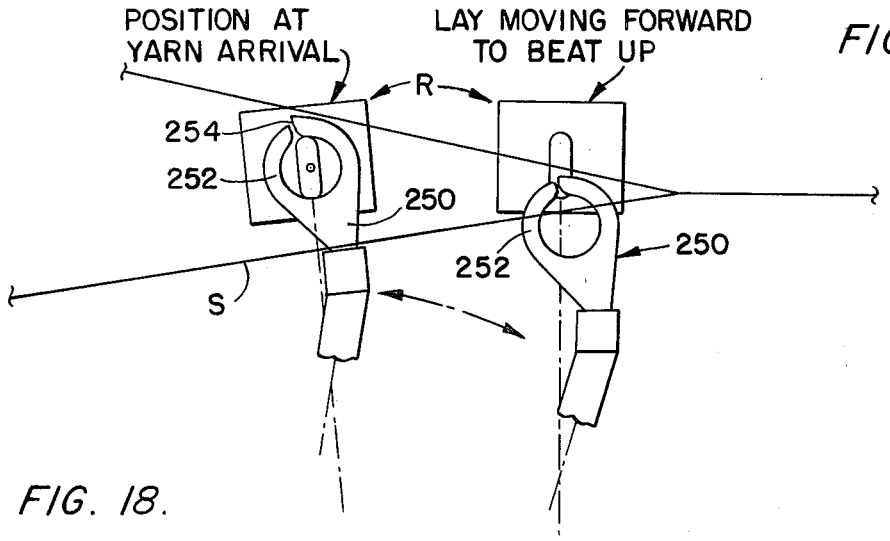
FIG. 16.
FIG. 18.
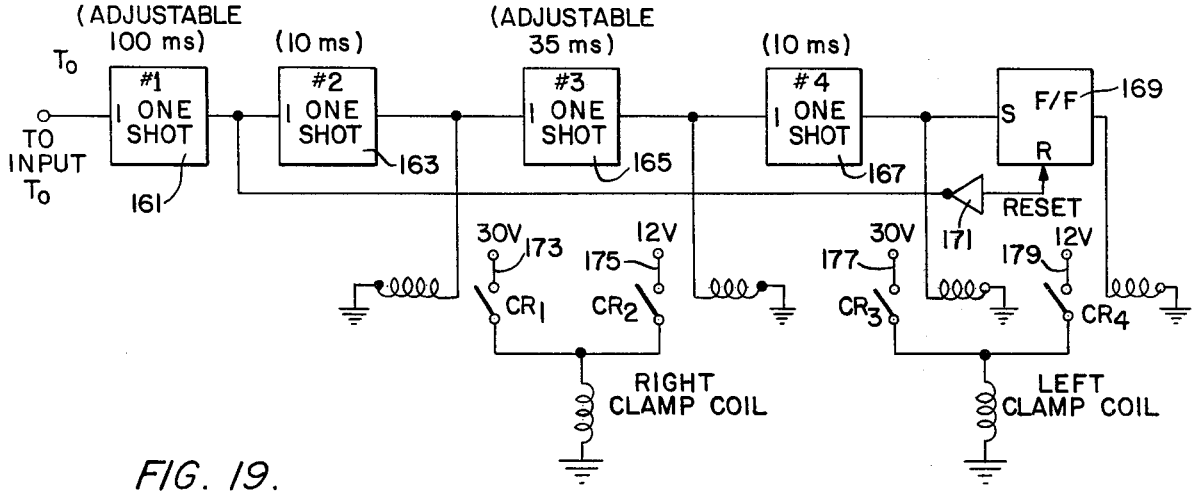
FIG. 19.
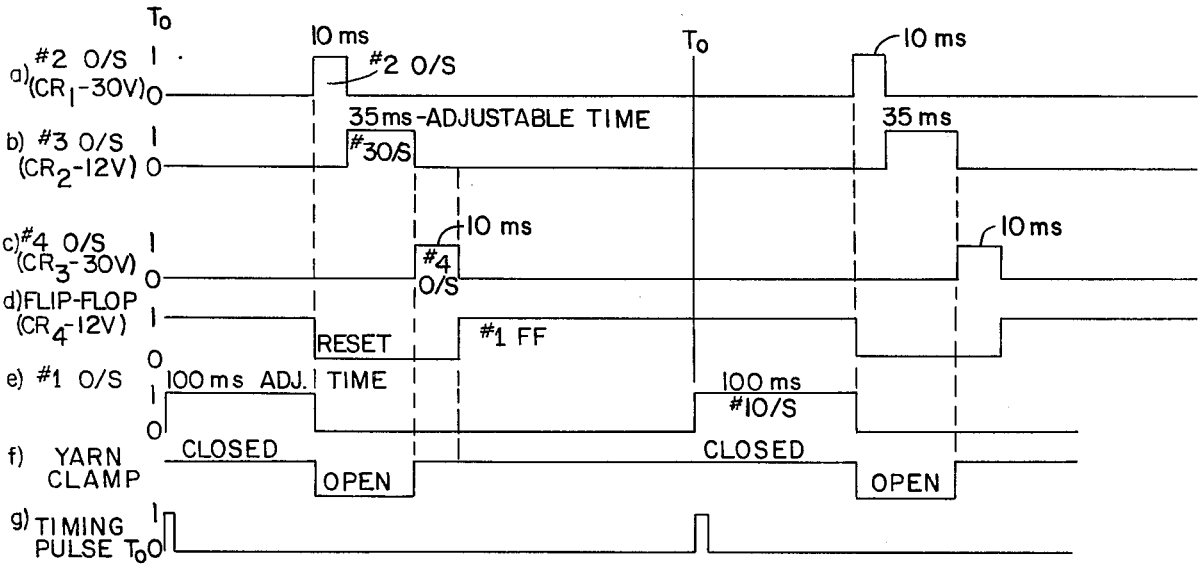

FLUID WEFT INSERTION LOOM MONITORING SYSTEM

FIELD OF THE INVENTION

This invention relates to the field of fluid weft insertion looms and is concerned more particularly with a monitorying system for monitoring the occurrence of the significant events occurring during the operating cycle of a loom of this type as well as with improved individual sensing units useful in that monitoring system.

BACKGROUND OF THE INVENTION

In a constant search for increased production, the textile industry in very recent times has heavily focussed on the use of looms for weaving fabric in which the filling or weft yarn is inserted by means of a flowing stream of a pressurized fluid, such as air or water. Such looms eliminate the necessity for a mechanical shuttle as the vehicle for projecting the weft yarn during weaving together with the mechanical driving mechanisms necessitated by a shuttle, and consequently offer inherent advantages from the standpoint of increased operation, simplified mechanical construction, and decreased operating noise, all of which are significantly desirable.

In a conventional shuttle operated loom, all of its elements are mechanically interrelated to the operation of a crankshaft and, consequently, the synchronization of the timing of the various significant events which transpire during each weaving cycle can be readily coordinated and adjusted relative to the rotation of the crankshaft. In a loom where the filling is propelled by a pressurized fluid stream, however, all of the significant operating events need no longer be directly related to crankshaft rotation and consequently it becomes more difficult to insure that the timing of these events is brought into the precise synchronism required for high speed operation.

Furthermore, where some of the instrumentalities employed in fluid weft insertion looms are operating independently of the crankshaft, when defective operation does occur, as will necessarily happen occasionally, it is considrably more difficult to trace the cause of a particular defective pick than was the case with conventional mechanically engineered looms.

OBJECTS OF THE INVENTION

The ultimate object of the present invention is to provide a monitoring system for observing the significant events happening during the weaving cycle of a fluid weft insertion loom and detecting when these events occur in relation to some reference point in that cycle to thereby provide an output indication of such detection for each of the observed events, preferably to terms of the elapsed time from the reference point, and to indicate by the absence of such detection, the failure of any such event to occur.

Another object of the invention is to provide an indication of the relative timing of the occurrences of the significant events during the operation of a fluid weft inserted loom so as to facilitate the initial installation and adjustment of the loom operation according to the desired specifications.

A further object of the invention is the provision of information, for example in the form of a visual display, of the relative occurrences in time of the significant operating events of the type of loom in question, so that in the event of defective operation, the loom attendant can deduce more readily, based on such information, the probable cause of such defective operation.

GENERAL DESCRIPTION OF THE INVENTION

In accordance with the present invention, a loom of the type where the weft yarn is projected across its shed by means of a pressurized fluid stream emitted from a projection nozzle is equipped with monitoring units for observing the principal significant events occurring during each cycle of operation, which events include the withdrawan during yarn projection of an accumulated supply of yarn from a cyclically replenishable source thereof, the pressurization of the throat of the insertion nozzle incidental to projection of the yarn, and the arrival of the leading end of the yarn at the opposite side of the shed, plus additional other events if desired, such as the opening of a yarn gripping clamp upstream of the nozzle, since replenishment of the stored yarn supply preparatory to the nect insertion cycle usually required restraint of the yarn adjacent the nozzle to prevent backwards withdrawal thereof out of the nozzle, etc. Beginning with a reference timing signal, preferably initiated at approximately front dead center, an output from each such monitorying unit is delivered to a corresponding counter to initiate counting thereby of a regular series of clock pulses and an indication of the instantaneous count thereof by an associated visual display, each such count continuing until the corresponding event being monitored has occurred, at which point the count is terminated to provide a stored display of the particular instant relative to the starting point at which the given event occurred. In case of the non-occurrence of any monitored event during a cycle, counting by the counter corresponding to the same continues without interruption to provide an indication that the event failed to occur within that cycle; however, the overall monitorying system is thereafter disabled so that continued operation of the loom, as normally takes place for at least one additional weaving cycle due to mechanical inertia, is prevented from influencing the state of the monitoring system. The invention also includes preferred improved individual monitoring units for observing each of the significant operating events identified above.

A preferred context for the execution of the present monitoring system is the particular fluid weft insertion loom disclosed in a related application Ser. No. 64,180, filed on Aug. 6, 1979 in the name of Charles W. Brouwer et al and commonly assigned herewith. This application discloses an improved operating loom of the type in question including a yarn storage unit wherein a predetermined length of yarn corresponding to the length to be inserted is metered out from a supply and collected in a storage zone, e.g. wound on a rotating drum, while a downstream end of the yarn reposes within the throat of an injection nozzle, being gripped by a positively acting clamp in the intervening region until just prior to the yarn insertion stage, at which point a pressurized fluid, in this case air or other compressible gas, is delivered virtually instantaneously to the nozzle throat for contact with the yarn reposed therein, the energy contained within the pressurized fluid emitted from the nozzle throat being sufficient to engage the yarn leading end and propel the same across the width of the loom through the shed of the warp threads being consecutively opened and closed in the usual manner of a loom, for eventual receipt at the opposite shed side within a suction tube wherein the yarn end remains until the weaving cycle is completed by the beat up of the newly inserted weft against the fell of the fabric being woven, at which time the exteriorly projecting ends of the beat up weft are sheared by means of shears. While the monitoring system of the present invention is especially suitable for association with the loom described in the above identified application, and the individual improved sensing units have been designed with this in mind, the present invention is not mainly limited in its applicability to that particular loom, or even looms using a compressible gas as the weft propelling medium, but, indeed, will be of equal utility with looms utilizing a noncompressible liquid, such as water, as the propelling medium.

BRIEF DESCRIPTION OF THE DRAWINGS

FIGS. 2–7 are detailed views of the yarn withdrawal or delivery sensing unit in which:

FIG. 2 is a top plan view of the sensing unit associated with its housing bracket;

FIG. 3 is a transverse cross-sectional view of the housing bracket taken generally along lines 3—3 of FIG. 2;

FIG. 4 is a right side elevation of the assembly of FIG. 2;

FIG. 5 is a front end elevation of the assembly of FIGS. 2 and 4 with the path of the yarn therethrough being indicated by a broken line;

FIG. 6 is an exploded view of the sensing unit and housing of FIGS. 2 and 4; and FIG. 7 is an exploded view of the sensing unit itself, omitting the laminated insulation spacer;

FIGS. 8–10 are detailed views of the solenoid operated yarn clamp in which:

FIG. 8 is a top view, taken in section generally along line 8—8 of FIG. 9, to reveal the interior of the unit;

FIG. 9 is a vertical cross-section view taken substantially along lines 9—9 of FIGS. 8 and 10, while FIG. 10 is a transverse cross-section view taken substantially along line 10—10 of FIG. 9;

FIGS. 12–15 are enlarged detail views of the yarn reception tube assembly and associated yarn reception sensing unit in which:

FIG. 12 is a top plan view of the assembly,

FIG. 13 is a front end elevation,

FIG. 14 is a side elevation, taken partially in cross section along lines 14—14 of FIG. 12, while FIG. 15 is a perspective view;

FIG. 16 is a fragmentary detailed view of the yarn reception sensing unit and weft guidance tube of the loom showing how the relationship of these components change during the beat up phase of the loom cycle, to position the yarn within the reception tube;

FIG. 18 is a diagram of the electrical circuit for operating the solenoid actuated yarn clamp;

FIG. 19 is a collection of wave forms illustrating the operation of the components of the circuit of FIG. 18.

DETAILED DESCRIPTION OF THE INVENTION

A. Overall System

Figure 1:
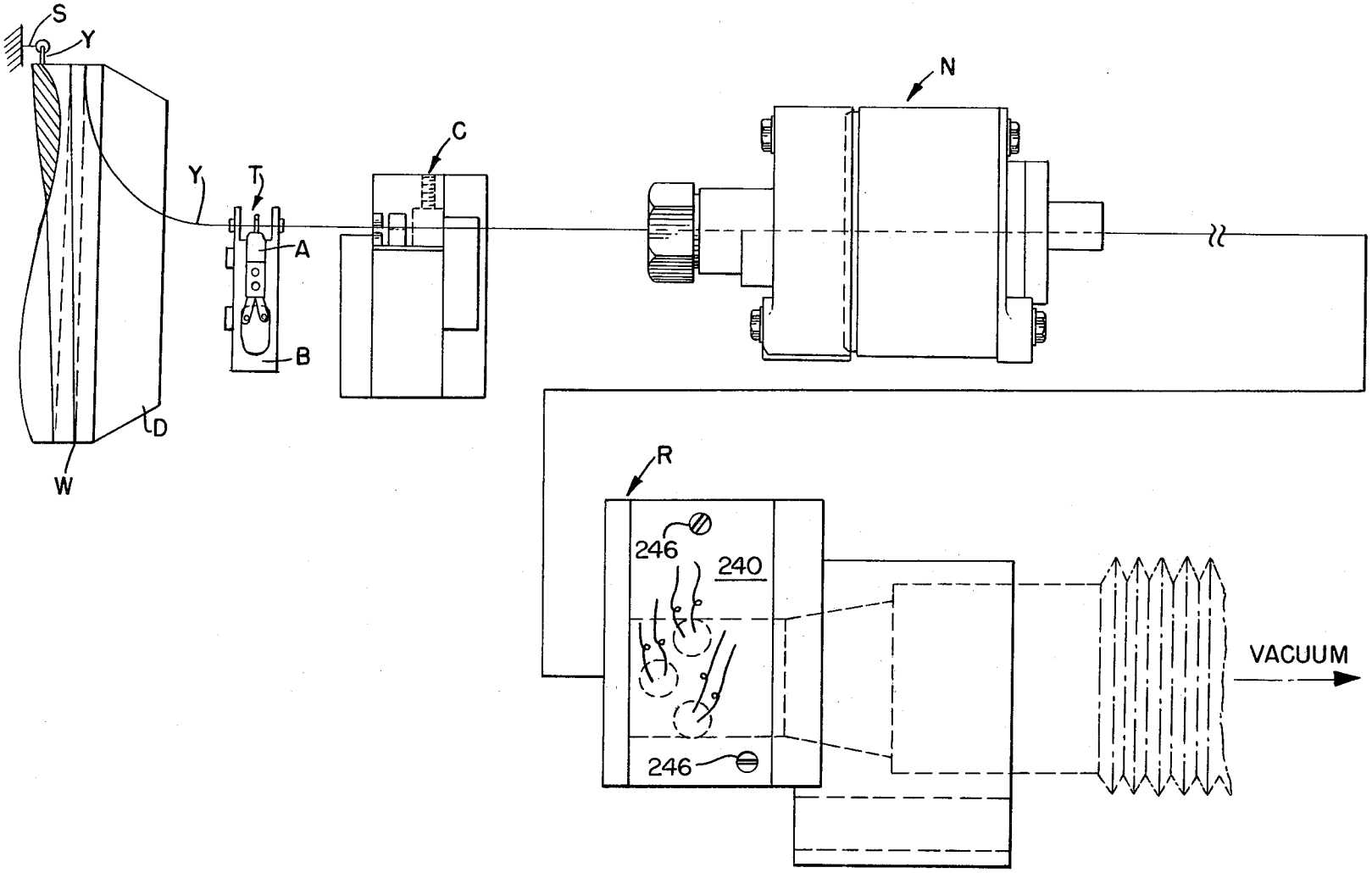
FIG. 1 is a side elevational view, somewhat idealistic, of the several individual event sensing units operative in the monitoring system of the invention arranged in sequence generally in operative relation as in a loom, all of the working parts of the loom, however, including supporting members for the units, etc., being omitted for sake of clarity, except as needed for an adequate understanding of such relation, e.g. of the yarn storage means.

An overall view of the arrangement of the sensing units employed in the monitoring system of the present invention appears in FIG. 1 wherein the components of the loom which have no material relation to the present invention have been omitted for sake of clarity. Thus, all of the interior loom components which form and define the shed, etc., do not appear in FIG. 1, which is broken away to suggest this absence. FIG. 1 does show the end of the yarn metering and storage unit which functions to meter out the appropriate length of yarn according to the width of the loom in question, and store the same in readiness for delivery to the insertion nozzle when needed. The yarn metering storage unit is the same as disclosed in the above identified related application, Ser. No. 64,180, and for further details of its structure and operation, reference may be had to the disclosure of that application.

As shown in FIG. 1, the yarn Y is delivered from a supply source not shown through a fixed yarn stop in the form, for example, of a guide aperture onto the surface of a storage drum D where it is collected into coils or windings W. From the coils W, the yarn passes through a yarn withdrawal or delivery monitoring unit generally designated T capable of sending a sudden rise in yarn operating tension incidental to complete withdrawal of the stored yarn supply from storage drum D, a solenoid-actuated yarn clamp generally designated C, which positively grips and holds the yarn during its accumulation on the storage drum and then releases the yarn preparatory to the weft insertion phase of the cycle, the weft inspection nozzle generally designated N which when actuated emits a blast of pressurized air through the throat thereof, and a yarn reception unit generally designated R which includes a suction tube for aspirating the leading yarn end therein with an associated sensing unit for sensing the actual arrival of the yarn end therein.

B. Individual Sensing Unit

Preferred embodiments of each of the individual sensing units of the overall system will now be described in detail in turn after which the electronic circuitry designed for processing the output signals delivered by the individual units for integrating these signals into a coordinated and interrelated functioning system will be analyzed.

1. Improved Yarn Delivery Sensor

Figure 7:
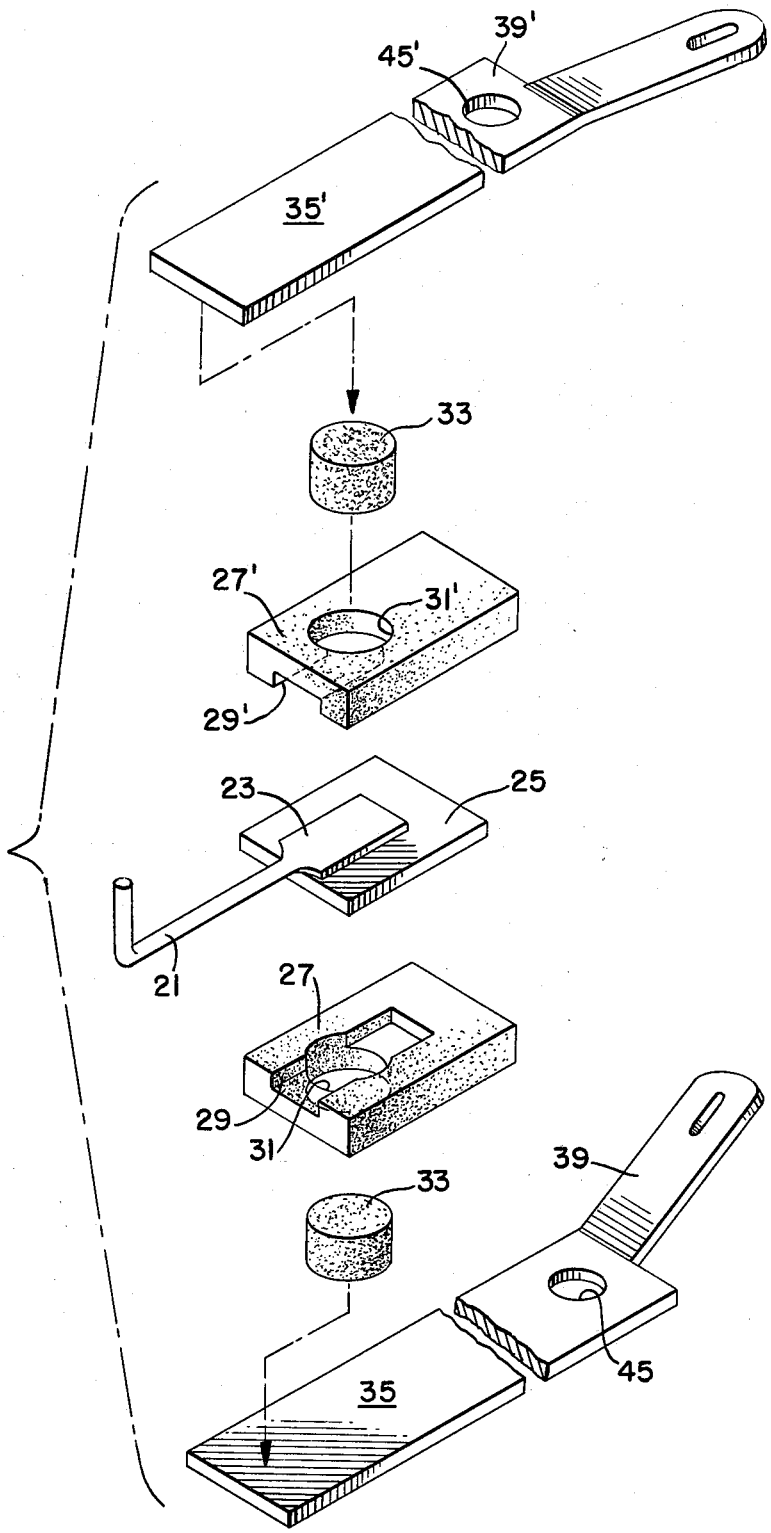

An improved yarn withdrawal or delivery sensing unit W adapted to be disposed in a position to be responsive to significant increase in yarn tension as a consequence of complete withdrawal of a prepared supply of yarn during delivery, which is preferably utilized in the overall monitoring system of the invention, is illustrated in FIGS. 2 through 7. It consists of a sensing assembly A and a supporting bracket B. As best seen in FIG. 7, the active element of the sensing assembly A takes the form of an L-shaped or hook-shaped yarn engaging finger 21 which has a flattened base end 23 which is secured, as by soldering, to one surface of a flat wafer-like "bimorph" crystal 25. Such crystals are commercially available, and, as is well known, are constructed of two thinplates or layers of piezoelectric material which has the characteristic of emitting an electrical voltage in response to the application thereto of mechanical stress. These two crystal plates are cemented together in such a way that when the crystal laminate is deflected by the application of mechanical force in a direction perpendicular to the starting plane thereof, the crystal laminate emits a momentary electrical voltage with a positive polarity and when the crystal returns to its original condition upon the removal of the applied mechanical force, it emits an electrical voltage of negative polarity. One commercial source of such crystals is Vernitron Piezoelectric Division, 232 Forbes Road, Bedford, Ohio, under the identification of catalog number 60873. The crystal 25 employed here is of generally square configuration, although other configurations are equally suitable, and the margins of the crystal are gripped between two opposed nonconductive holders 27,27' formed of neoprene or like insulating material, which are grooved on their respective adjacent faces toward the piezoelectric crystal with shallow recesses 29,29' so as to facilitate deflection of the crystal when a mechanical load is applied to finger 21. To create an electrically conductive path to each side of the thus supported crystal 25 an aperture is formed in each of the insulating pressure pads as at 31, 31' and a plug 33, 33' of a conductive compressible form is inserted into each such aperture. The composite of the pads, plus, crystal, and finger is inserted with a pressure fit between the elongated flat electrically conductive fingers 35, 35' which are hend in spaced apart electrically isolated relationship by a laminated block of nonconductive material 37 (omitted in FIG. 7, seen in FIGS. 4 and 6). The metallic fingers project exteriorly of the opposite end of the laminated stack at diverging angles as at 39, 39' (see FIG. 6) to form readily accessible terminals for the connection thereto of appropriate electrical wiring. The assembly A is completed by insulating cover plates 41, 41' and held together by bolts 43, the apertures therefor in metal fingers, as at 45, 45', being oversize to prevent electrical contact therewith, and the bolts 43 can anchor the assembly in its supporting bracket B. To shield the active end of assembly A, a sleeve 47 of heat-shrinkable material is placed over the projecting end of the assembly and shrunk therearound as seen in FIG. 6.

The sensing assembly just described can, of course, be mounted in a variety of different ways but a useful supporting bracket B therefor has been designed and is illustrated in FIGS. 2 through 6. This bracket consists of a generally channel-shaped body 51 having apertures in its base as at 53 for easy attachment to a fixed part of the loom or other supporting surface. The sensing assembly A just described fits in the forward end of the channel 54 (see FIG. 6) of the housing, which end is open for that purpose, being held in place by the screws 43 in threaded engagement at their lower ends with threaded openings furnished for that purpose in the base of the housing. In this position, the sensing finger 21 itself projects exteriorly of the open end of the body 51 and aligned guide apertures 55 are formed in wear-resistant inserts 57 inserted in ears 59 projecting forwardly from the front side walls of the housing. These apertures are coaxial and are displaced to one side of the working level of the yarn engaging finger 21, their common axis being in the illustrated arrangement disposed below finger 21, so that yarn passing through guide apertures 55 and over the finger 21 is deflected by the finger into an at least slightly sinuous path. Thus, if tension is imposed upon the yarn, that tension works to stretch the yarn out of that sinuous path and thereby applies a mechanical force agaist the yarn sensing finger. Clearly, the relationship of the yarn engaging finger and the guide apertures is subject to variation from that shown while still achieving the intended functional result and the particular orientation of the drawings if not intended to be critical.

The remainder of the channel 54 in the housing is enlarged as at 61 so as to accommodate the electrical terminals 39, 39' of the assembly A as well as the wires connected thereto and while the rear end of the channel could be open similar to its front, it is preferably closed except for a semicircular passage 63 to permit the electrical leads to easily exit from the interior of the channel, as shown in dotted lines in FIG. 4.

Figure 20A:
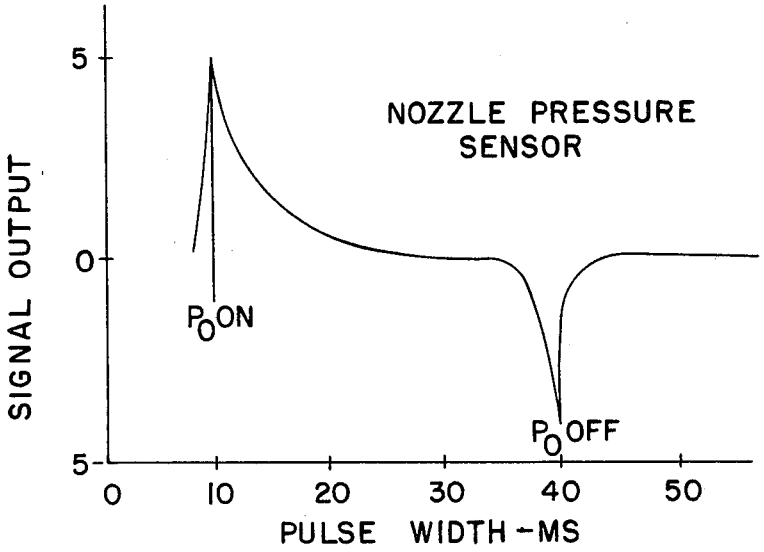
FIG. 20 is a composite graph showing oscillograph traces of typical acceptable patterns for the output of the tension sensing unit T (top curve) and output of the nozzle sensing unit N (bottom curve), both measured against time.
Figure 20B:
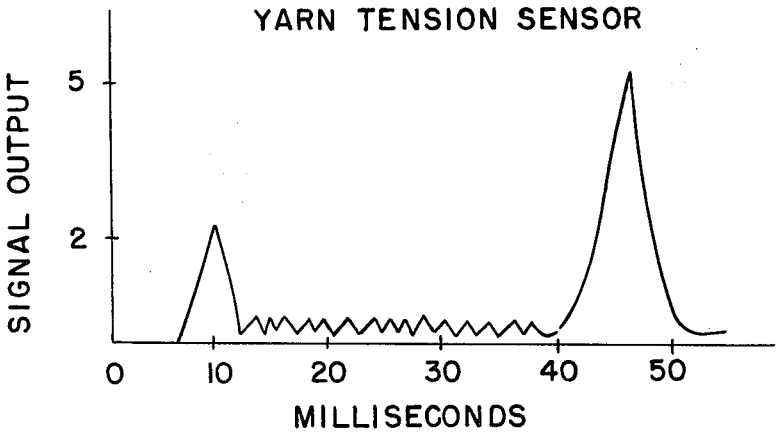

An oscilloscope trace of a typical output pulse emitted by the tension sensing unit T is illustrated at the top of FIG. 20. During the weft insertion phase of the loom cycle, the yarn is withdrawn from the coils W on storage drum D through the tension sensing unit T and at the beginning of the withdrawal, an initial pick of intermediate magnitude designated x will be generated by the sensing unit due to the inertia of the yarn resisting its withdrawal. As the yarn continues to play off the drum, random tension fluctuations appear therein, as indicated at y, and finelly as the yarn is completely withdrawn and pulled taut against the fixed stop S, there will appear a sharp tension peak designated z which is the significant signal provided by the sensing unit in indicating complete withdrawal of the stored yarn supply from the storage drum. The height of the several peaks just mentioned may well vary from loom to loom and no particular significance is intended to be attached to the precise magnitudes shown in the drawings which are given as a general guide showing typical behavior during a satisfactory operation. It will be understood, however, that significant deviations from this general pattern can serve to aid in interpretation of the cause of a particular operating defect. Thus, if the terminal sharp pulse z should not occur, then this would signify the failure of the yarn supply to be completely withdrawn.

2. Improved Solenoid-Actuated Yarn Clamp

Figure 8:
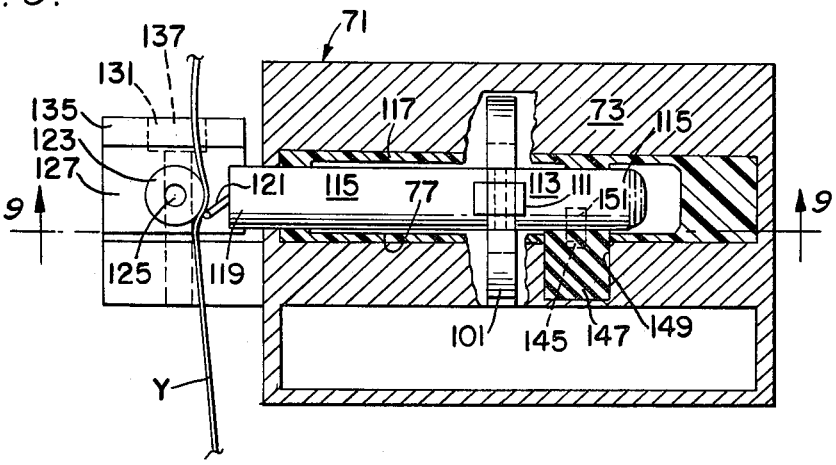
Figure 9:
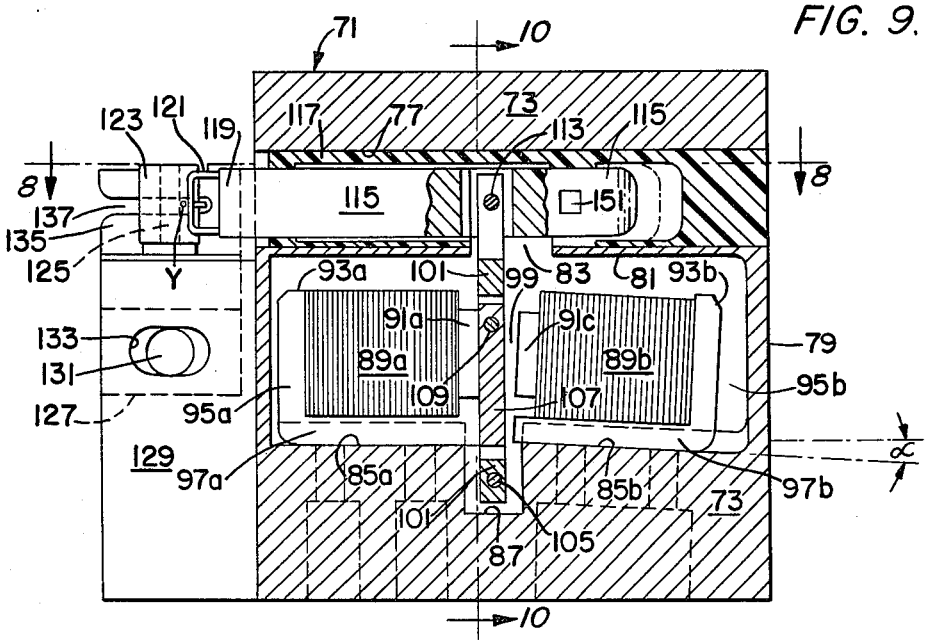
Figure 10:
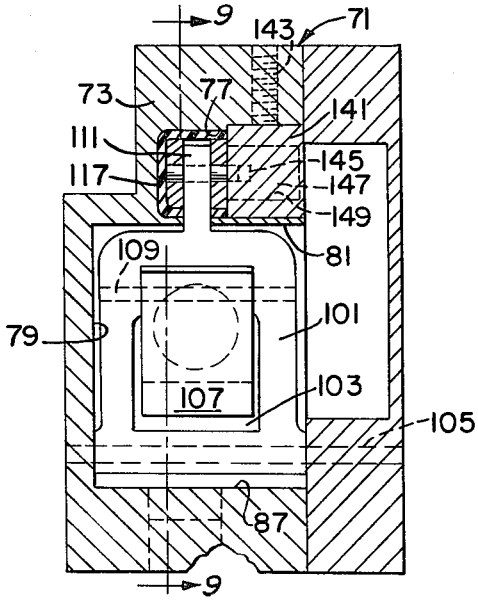

While it is within the scope of the broad concept of the present invention to utilize any type of solenoid-actuated yarn clamp and to derive a control signal from the actuation of that clamp in any of the ways available to do so in the art, there has been developed a special high speed solenoid-actuated clamp assembly that possesses operating characteristics peculiarly suitable for purposes of the overall monitoring system of the invention. This specially designed preferred clamping unit C is illustrated in FIGS. 8 through 10.

The solenoid is enclosed within the housing generally designated 71 the structure of which obviously can be subject to broad variation, but in the illustrative embodiment is constituted of a housing body 73 having bottom, top, opposed end walls and one side wall, and a removable side wall cover 75 forming the other side wall. The interior of the body is open and is divided into a shallow top compartment 77 together with a larger lower compartment 79 separated by a partition 81 which is interrupted as at 83 for a purpose to be explained later. The interior floor of the bottom wall of housing body 73 has two sections 85*a*, 85*b* the planes of which are relatively slightly inclined, say about 5°-10°, with an intermediate recess 87. Each of the floor sections 85*a*, 85*b* carries one of the coils or windings 89*a*, 89*b* of the solenoid and the area of these coils therefore diverge slightly, as indicated by the angle $\alpha$ between the cotted lines at the right of FIG. 9, and being about 5°-10° as explained.

Each of the solenoid windings 89*a* and 89*b* includes a center core 91*a*, 91*b* formed of soft iron with good magnetic properties and the mutually facing inner ends of these cores project somewhat beyond the corresponding limits of the windings with their end faces spaced apart a short distance and diverging at the same small angle $\alpha$. The opposite end of each of the center cores 91*a*, 91*b* is formed as an L-shaped pole piece 93*a*, 93*b* also constituted of strongly magnetic soft iron, having the upstanding leg 95*a,b* thereof abutting the outward end of the core and its base leg passing beneath the windings to terminate in line with the plane of the end face of the associated core, thus, in effect, both poles of the magnetic core of each winding are located at the same end of the winding with their ends in alignment but in vertically spaced apart relation. The aligned end faces of the poles are separated by a space 99 and planes passing therethrough intersect at the same small angle $\alpha$.

Within the space 99 separating the poles of the solenoid windings is a two-piece or duplex armature of which the premier body 101 has a generally rectangular yoke-like configuration, with its central area open as at 103. The lower end of body 101 extends into recess 87 in the housing body floor and is pivoted there for rocking movement around a transverse axis 105. Within the open central area 103 of the primary body 101 swings a secondary armature element 107, pivoted at its upper end on a pin 109 anchored in the upper ends of the primary body. As best seen in FIG. 10, the axes of the opposed solenoid windings 89*a*, *b* intersect at approximately the midpoint in the vertical dimension or height of the duplex armature assembly just described and well below the support axis for the swinging secondary element 107. It will be seen that the armature assembly as a whole is free to pivot bodily in the space 99 between the end faces of the opposed poles of the windings while the secondary armature element can swing independently.

The operation of the solenoid so far described is as follows: Assuming the duplex armature to be in a starting position abutting core 91*a*, as shown in FIG. 9, as the opposite winding 89*b* is energized (the electrical leads to the windings being omitted as unnecessary), the duplex armature responds in two-step fashion. Maximum magnetic field flux will exist across the end of pole piece 97*b* and the lower end of secondary element 107. The secondary element being freely swingable swings under the attracting force of this magnetic flux into contact with the adjacent end of the L-shaped pole piece 93*a*, *b*. Due to this contact, the total air gap in the flux field is reduced and the flux field across the gap between the core 91*b* and the swingable secondary element 107 is thereby itensified which increases the magnetic attractive force of the coil for the upper end of secondary element 107 therefore bodily moves into contact with the core and, in so doing, carries along the primary yoke-shaped armature element 101. It has been found that this two-step action of the duplex armature actually achieves a significantly accelerated virtually instantaneous response of the armature which is highly desirable for high speed operation as is required in the operating loom.

The upper end of the primary yoke-like armature element is extended in tongue-like fashion as at 111 and privotally connected by a pin 113 to an elongated tubular slide or plunger 115 mounted for sliding movement within the upper compartment 77 of the housing 71. Preferably, the upper compartment is made oversize and a guide sleeve 117, which can be made of low friction material, such as "Teflon" plastic, is inserted therein, the interior of the guide sleeve being accurately dimensioned to receive tubular plunger 115 and to support the same for free reciprocating movement with a minimum of friction and wear. Tubular plunger 115 projects at one end externally of the housing as at 119 and from end 119 projects a C-shaped bail 121 which functions as the movable part of the yarn clamp. The fixed part or anvil of the clamp takes the form of cylinder 123 preferably mounted for free rotation about a vertical post 125. The bail moves as the plunger reciprocates in a vertical plane which is offset slightly to one side of the axis 125 of the cylinder 123 so that it makes contact with the periphery of the cylinder to one side of dead center. The throw of the bail 121 and sliding plunger 115 is adjusted to ensure the bail impacts firmly against the cylinder periphery and preferably must flex slightly out of a normal planar condition when in its ultimately projected position (as seen in exaggerated fashion in FIG. 8). As a consequence of this arrangement, the impact of the bail against the cylinder causes the cylinder 123 to rotate gradually about post 125 and thereby distribute the wear over its entire periphery and greatly prolong its useful life.

The supporting post 125 for cylinder 123 projects upwardly from a platform 127 attached to a flange-like extension 129 of the front end by means of a bolt 131, the opening for which is horizontally elongated as at 133 to allow the position of cylinder 123 to be adjusted relative to the path of the bail 121. As seen in FIGS. 8 and 9, the back edge of the platform carries an upstanding flange or ear 135 which has a horizontal yarn guiding slot 137 cut therein for stabilizing the path of the yarn Y passing between the bail and cylinder. Preferably, guiding means are provided for the yarn on the front side of the cylinder but such means need not be associated with the housing and are consequently omitted.

As explained, the top, back side, and interior partition 81 of the housing define a three sided channel 77 for receiving the clamp plunger and its guiding sleeve and the open side of this channel is closed by means of an elongated cover block 141 held in position by set screws 143. In accordance with the invention, the actuation of the yarn clamp serves to generate a control signal and while this could be achieved in any number of ways within the skill of the art, a preferred approach is to mount a Hall effect switch 145 in an insulating plug 147 fitted in a recess 149 on the interior side of the cover block for cooperation with a small magnetic plus 151 embedded in the clamp plunger 114. The relative positioning of Hall effect switch 145 and magnetic plug 141 are such that the two coincide with the switch when the clamp carrier is projected fully outwardly to pinch the yarn between the bail and the cylinder and, in effect, close the clamp. In this position, the Hall effect switch is closed by the magnetic plug generating a positive control signal which is then utilized for purposes to be described later.

It will be obvious that the front side cover 75 of the housing 71 can be removed for easy access to its interior compartments to permit servicing and/or replacement of any of the parts of the unit. The angle of separation between the poles of the respective cores 91*a, b* is obviously selected to match the pivotal angle of the primary armature body 101. Adjustment of the winding assemblies of the solenoid can be facilitated by anchoring the assemblies on the housing with bolts (not seen) passing through oversize apertures.

The electrical circuit for energizing the solenoid windings of the clamp can naturally take many forms but a preferred circuit which has been found to be particularly suitable to the goals of the invention is illustrated in FIG. 18. This circuit utilizes a dual voltage concept in which the solenoid windings are subjected to an excess voltage, above their normal rated voltage, for a brief period at the beginning of each stage of operation of the solenoid and hence receive added energy to achieve positive and rapid response of the armature movement. For example, the windings of the unit in question are designed, say, for normal operation at 12 volts, but for a few milliseconds at the beginning of each transition of the armature, a significantly higher voltage, for example, about 30 volts, is applied across each winding to increase the magnetic flux field set up between their poles and the armature.

Further, it is preferred that this dual voltage concept be applied in a predetermined automatic stepwise sequence whereby when the operative cycle of the solenoid clamp has been once initiated, the unit proceeds automatically through its entire cycle without further control intervention. The circuit illustrated in FIG. 18 is effective to accomplish this automatic stepwise sequential energization. A timing pulse or signal $T_0$, generated in a manner to be explained more fully later, is applied to the input of a first or #1 one-shot 161. As known, a one-shot is an available electronic device which is capable upon the application thereto of either a rising or falling pulse of emitting an output pulse for a predetermined duration, according to its characteristics. In this case, the #1 one-shot 161 is activated by the rising pulse of the $T_0$ signal and is adapted to be adjusted in the length of its duration, an exemplary duration being 100 ms. The output from #1 one-shot 161 is delivered to the input of a second (#2) one-shot 163 which responds to a falling pulse and emits an output pulse for a period of e.g. 10 ms, and this output pulse in turn passes to a third (#3) one-shot 165 which again responds to a falling pulse and is adjustable in its duration, for example 35 ms. The output next passes to a fourth (#4) one-shot 167 responsive to a falling pulse with a duration of 10 ms, for example, which passes its output signal to the S input of an S-R flip-flop 169 which upon receipt of a positive pulse latches the pulse in the positive mode until it is reset by a signal at its R input. Resetting is accomplished with the output of the #1 one-shot 161, after inversion at the inverter 171 of its polarity so that the flip-flop is reset at the end of the output signal of #1 one-shot 161.

The opposed windings 89 *a,b* of the solenoid unit are for convenience designated right and left, according to their relationship in FIG. 9 and each winding is connected in parallel to each of a 30 volt and a 12 volt source through corresponding control relays. Relay $CR_1$ controls the 30 volt line 173 and the coil 163 of this relay is connected to the output of #2 one-shot 163 while relay $CR_2$ is in the 12 volt line 175 for the right winding and its coil is connected to the output of #3 one-shot 165. Relay $CR_3$ connects the left solenoid winding to the 30 volt source via line 177 and its coil is connected to the output of #4 one-shot 167, while relay $CR_4$ connects the left coil to the 12 volt source by line 179 and its coil is connected to the output of the flip-flop 169.

The circuit of FIG. 18 in effect constitutes a cascading series of four one-shots plus a terminal flip-flop which series responds automatically to carry out a complete operative cycle upon the receipt of an initiating pulse $T_0$ and then resets itself for the next cycle upon arrival of the next timing pulse. The operation of the circuit is illustrated by wave forms a–g in FIG. 19, and while such operation is undoubtedly self-explanatory, it will be summarized briefly as follows. A brief timint pulse $T_0$ (wave form g) is initially applied to the input of the #1 one-shot (wave form a) which holds the pulse for the adjustable period, in this instance 100 ms. When the output pulse of the #1 one-shot falls, the #2 one-shot is activated in the positive mode (wave form b) and emits a positive pulse for the set period of 10 ms which closes relay $CR_1$ for 10 ms applying 30 volts across the right solenoid coil for that period, opening the clamp (waveform f). When the #2 one-shot output ceases, the #3 one-shot is activated for the set time, in this case 35 ms, and the right coil thereby receives 12 volts over this period via relay $CR_2$ and the clamp remains open. With the expiration of the output of the #3 one-shot, the #4 one-shot is activated for its interval of 10 ms (waveform c) and the 30 volt source is thereby connected via relay $CR_3$ to the left winding of the clamping unit so as to return the solenoid armature and clamp to closed position and upon the expiration of #4 one-shot output, the flip-flop goes positive and latches its output in the positive mode, which connects the left winding to the 12 volt source through relay $CR_4$ and thus holds the 12 volts on the left coil so that the clamp remains in closed position and continues so (to hold the clamp closed) until the flip-flop is reset by the falling pulse of the #1 one-shot simultaneously with the activation of the #2 one-shot to open the clamp when the next timing pulse $T_0$ is received.

The timing of the opening of the clamp obviously has to be correlated with the working cycle of the loom so that the clamp is open to release the yarn for insertion into the loom shed when the loom is at the proper point in its operative cycle, i.e., approaching back dead center, for such insertion to take place. $T_0$ is fixed relative to the loom cycle and will normally correspond to front dead center and the purpose of the adjustable duration of the #1 one-shot is to allow the timing of the clamp actuating sequence to be varied to suit the requirements of the particular weaving cycle.

The Insertion Nozzle Sensing Unit

Figure 11:
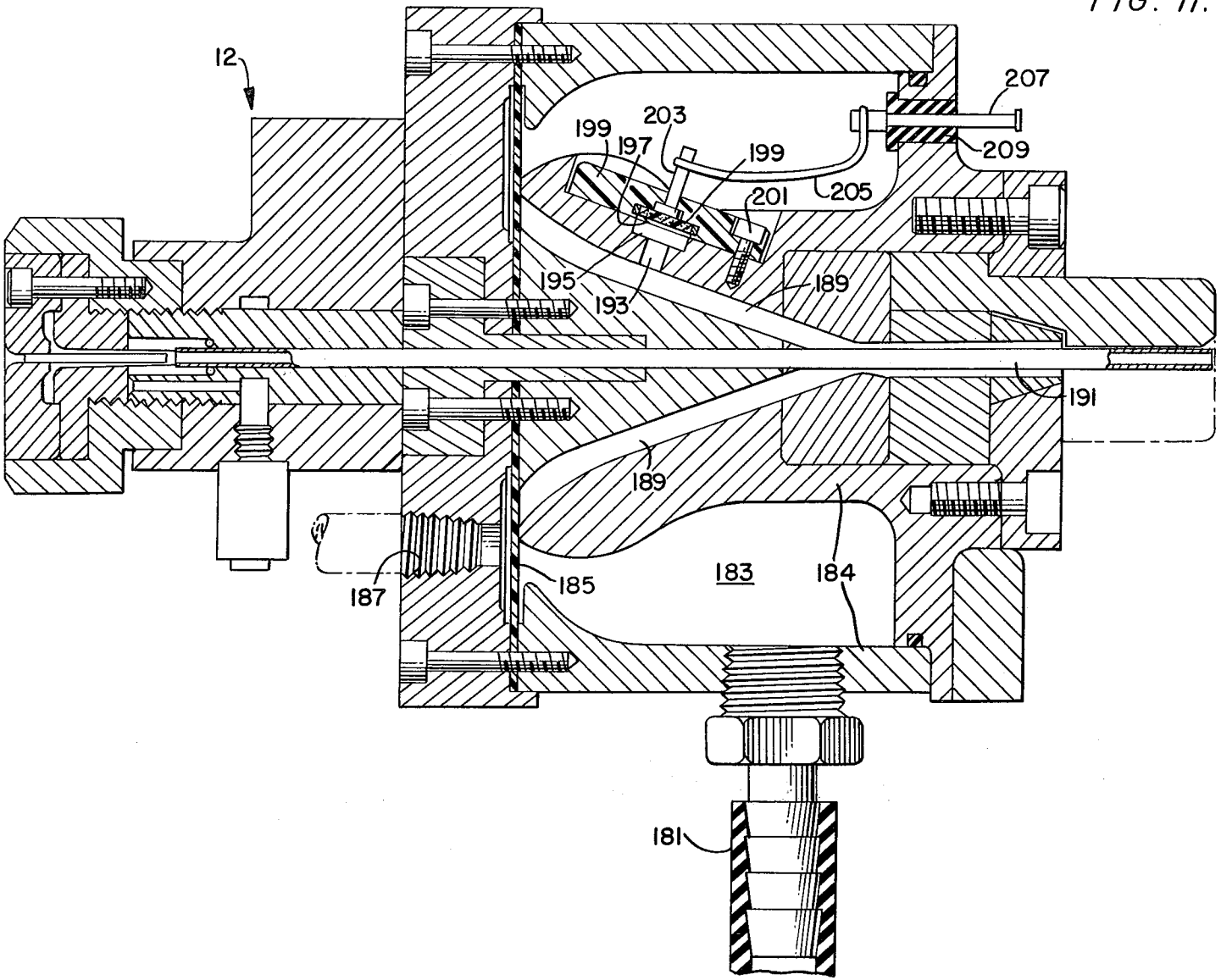
FIG. 11 is an enlarged view taken in cross-section vertically through the yarn insertion nozzle showing the details of the pressure sensing unit associated therewith.
Figure 12:
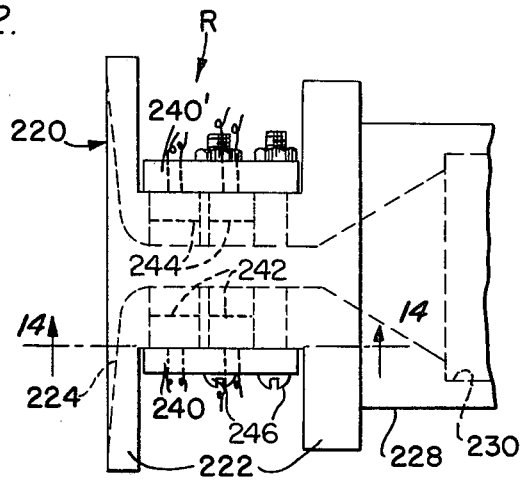
Figure 14:
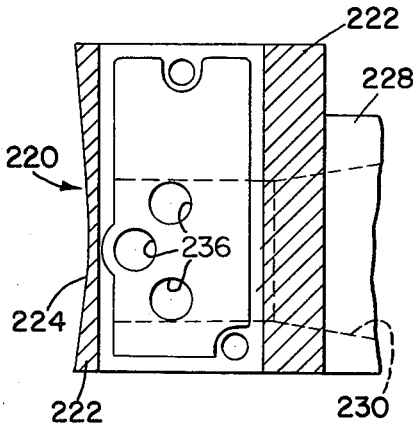
Figure 13:
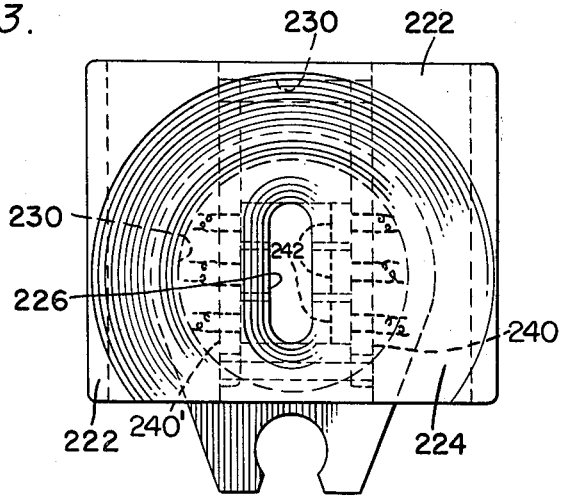
Figure 15:
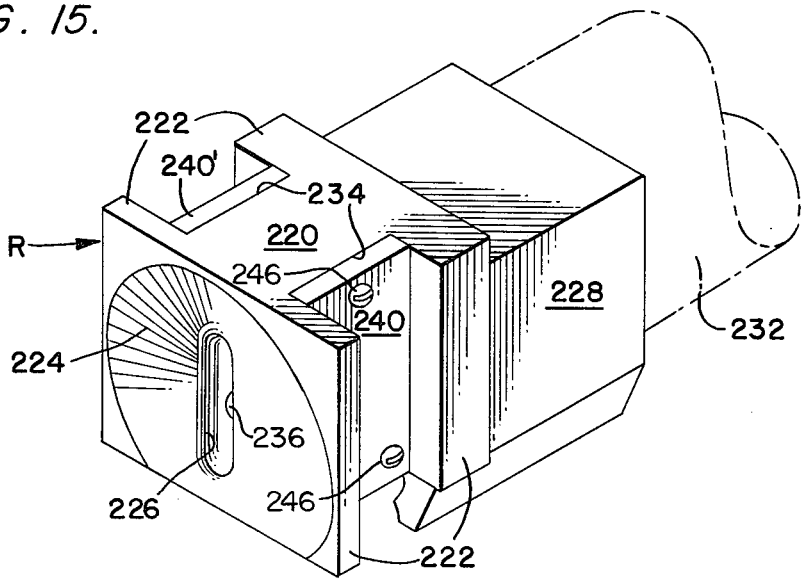

A preferred embodiment for detecting the sudden build-up of fluid pressure within the yarn insertion nozzle N which occurs when the nozzle is "fired" to emit a stream of pressurized fluid around the end of the yarn and transport the same across the shed of the loom is shown in FIG. 11. The nozzle is this embodiment is generally similar to that disclosed in prior application Ser. No. 64,180 in which pressurized air is delivered from a pressurized source via the port 181 into an interior chamber 183 within the nozzle body 184 which constitutes a supply chamber for the pressurized gas. One end of the chamber is closed by means of a flexible diaphragm 185 which is urged to such closed position by means of a pressurized control fluid applied its opposite face by way of a control fluid port 187. By venting the pressure of the pressurized control fluid, the diaphragm is freed to move away from the end of the supply chamber and permit the compressed gas therein to exit through the generally conically shaped annular throat 189 of the nozzle. The leading end of the yarn to be projected is threaded through the nozzle throat within a guide tube 191 extending axially through the entire nozzle unit. The details of the manner of controlling the diaphragm action and other features of the nozzle unit itself are better revealed in the description of the above-identified application and may be referred to in that connection.

Along the length of the annular conically contoured nozzle throat passage 189, there is provided a port 193 opening at one end into the throat passage and at the other into an enlarged interior sensing chamber 195. The opposite wall of chamber 195 is closed by means of a bimorph crystal wafer 197, similar in construction and behavior to that described previously, and seated at its margins over the edges of the chamber walls. On the back side of bimorph wafer 197 opposite the sensing chamber 195 is a compressible conductive foam pad 199 which is compressed against the wafer to hold the latter in place by a dielectric cap 189 fastened by means of bolts toe the hozzle body 184. An electrical connector 203 extends through the dielectric cap into conductive contact with the conductive foam pad and an electrical lead 205 connects this connector to a connector 207 extending through the end wall of the nozzle body within a dielectric sleeve 209. The exterior end of connector 207 serves as a terminal for one end of an electrical lead (not shown) connecting the same to the remainder of the circuit to be described.

The operation of the nozzle sensing unit is as follows. When the diaphragm 185 opens and releases fluid from chamber 183, fluid pressure builds up within the nozzle passageway 189 and finds its way through port 193 into sensing chamber 195 to be applied against the bimorph wafer 197. The bimorph deflects in response to such applied pressure and generates an electrical signal incidental to such deflection which can be transmitted through the connectors and leads to the remainder of the circuit.

While it is preferred that a compressible gas, such as air, be employed as the yarn propulsion medium, it will be apparent that the function of the sensing unit is not limited to a compressible gas but will be equally effective with any pressurized media, whether gaseous or liquid.

There is shown in the bottom of FIG. 20 an oscilloscope trace for a typical output signal from the pressure sensing element in the nozzle N. Thus, when the nozzle is pressurized at $P_o$, a sharp initiation pulse is emitted by the bimorph crystal and appears in the trace in the form of the peak designated a which tapes off once the bimorph crystal has stabilized in its new position. Then, as the nozzle is depressurized at the end of the insertion phase, the bimorph crystal emits an output pulse of the opposite polarity which appears in the trace at the peak designated b. In this way, the nozzle sensing unit provides a definite indication of both the beginning and end of its pressurization.

Yarn Reception Sensor

As disclosed in prior application Ser. No. 64,180, the end of the lay of the loom opposite the insertion nozzle is provided with a suction tube which defines a suction opening facing toward the shed and adapted to receive the leading end of the yarn after its insertion across the shed and to hold that end as the lay rocks to beat up the inserted yarn into the fell of the fabric being woven. The prior application also generally discloses the association with the suction tube of a sensing means for detecting the arrival of the leading end of the yarn within the suction opening, which detecting means can take the form of one or more light emitters impinging light beams upon cooperating photocells aligned transversely of the opening axis so that passage of the yarn into the suction opening interrupts at least one of the light beams and thus momentarily alters the output of a photocell to provide a signal indicative of yarn arrival. An improved yarn reception sensing unit R has been designed and forms the subject of FIGS. 12–15 of the drawings.

According to the improved yarn reception sensing unit R, the free end of the suction tube adjacent the shed is constructed of a solid block 220 of any convenient plastic or the like having at both of its ends flanges or wings 222 projecting laterally of the axis of the suction opening therethrough. At the inner end nearer the shed, the laterally projecting wings 222 increase the effective span of the suction tube, that is to say, the "target area" to be reached by the leading end of the yarn after its traversal of the shed, and preferably the face of this end is formed with a shallow conical recess 224 which merges at its interior into the vertically oriented suction slot 226. The flanges at the outer end of block 222 facilitate the attachment of the block to an adapter section 228 which has an internal bore 230 making a transition from the vertically elongated suction slot 226 to the circular interior of a vacuum tube 232 (shown in dotted lines only in FIG. 15) telescopically inserted into the bore 230 of adapter section 228.

Penetrating the bottom walls 234 of each of the vertical channels defined in the sides of block 220 by the flanges 222 is an array of three apertures 236 (see FIG. 14) which are aligned transversely with one another to permit the passage of light beams through the walls 234 and across the suction opening. The apertures 236 in each array are preferably arranged in a standing triangle or semi-diamond with the upper and lower openings coinciding with the upper and lower limits of slot 226. Plates 240, 240' fit over the bottom channel 234, one plate 240 carrying on its interior face a set of light emitters or sources 242, and the other plate 240' carrying a set of photocells 244, both sets being disposed for registration with the aperture array on the corresponding side of block 220 (and seen only schematically in FIGS. 12 and 13 of the drawings with fragmentary electrical leads). The plates are removably secured to the bottom walls 234 by bolts or the like 246 and can be readily replaced when necessary.

Similar to prior application Ser. No. 64,180, the yarn reception tube and sensor unit R is mounted on the lay of the loom and thus moves bodily back and forth with the lay as the lay rocks during weaving between back dead center, which is the approximate point at which the yarn is inserted within the shed, and front dead center where the yarn is beat up into the trailing edge of the fabric being woven. As more fully explained in this related application, the projection of the yarn through the shed under the impetus of a stream of a fluid medium issuing from the insertion nozzle is assisted and facilitated by means of guidance tube 250 extending substantially the full length of the shed and shown schematically in FIG. 16. This guidance tube must be withdrawn from the shed prior to beat up of the freshly inserted yarn and in order for such withdrawal to be possible the tube is constituted of a plurality of thin annular segments 252 (only the end of one of which is visible in FIG. 14) that are supported in aligned relationship on the lay so that the annular tube elements can move in interdigitating fashion between the warp threads. The guidance tube elements move with the lay and are withdrawn from the lower side of the shed S as the lay moves forward to beat up position. The inserted weft thread lies within the guidance tube and moves with the guidance tube until restrained against such movement by the interference of the warp yarn making up the lower side of the shed, and then escapes from the guidance tube elements through a slot 254 provided commonly on the upper side of such elements for that purpose. In addition to moving bodily with the lay, the guidance tube is supported for independent vertical movement relative to the lay by means not shown but fully described in the related application and is reciprocated downwardly and then upwardly in synchronism with the rocking action of the lay so as to be fully withdrawn from the shed S before the lay reaches front dead center. During the beat up phase, therefore, the strand is not only displaced forwardly but is drawn downwardly within the shed by the guidance tube and the leading end of the yarn held within the suction tube follows such movement. The suction tube itself, however, is fixed on the lay. Thus, the natural consequence of loom operation during beat up is to depress the leading end of the tube while being held thereby towards the bottom of the suction slot thereof to achieve a natural rest position for the yarn at front dead center in a position intersecting the lowermost of the LED-photocell sensing units. In this way, generation of a control signal by the reception sensing unit is ensured if the yarn had indeed been received there.

Overall Monitoring System

Figure 17:
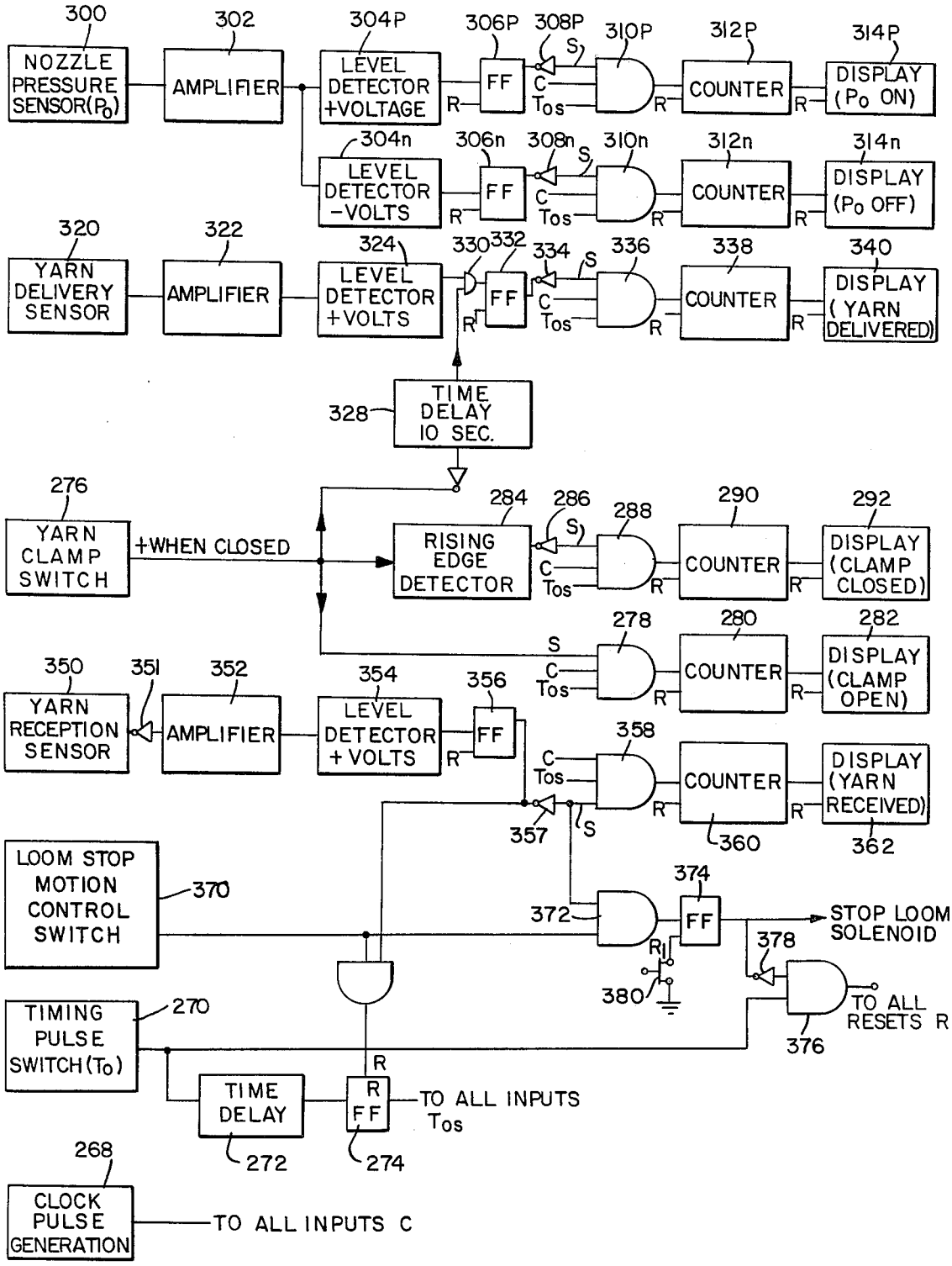
FIG. 17 is a circuit diagram of the overall monitoring system of the invention.

A circuit diagram showing an illustrative and preferred operating circuit for the individual sensing units as well as the manner in which those units are integrated into an overall monitoring system is illustrated in FIG. 17 of the drawings. In this circuit a separate channel is provided for each of the individual sensing units and, in general, each such channel includes a R-S flip-flop which receives at its S input a starting or timing pulse $T_o$ and latch its output to provide a positive signal until reset by the application to its R input of a reset signal, thereby delivering from its output an extended or stretched timing pulse $T_{os}$ until reset; an AND gate having three inputs; namely, a $T_{os}$ input receiving the $T_{os}$ output signal from the flip-flop, a C input receiving a series of clock pulses of some predetermined frequency from a clock pulse generator, and a third receiving a sensing signal or pulse from the individual sensing unit; a counter connected to the output of the AND gate to count the number of pulses received when the AND gate is operative; and a display driven by the counter to provide a visual display of the total count reached by the counter at a given time.

Turning now to a more detailed description, a clock pulse generator 268 delivers a continuous series of clock pulses and applies the same to the C inputs of the AND gates of the various channels by connections, not shown. A monitoring cycle is initiated at some predetermined reference point during each cycle of the loom, preferably starting at front dead center, by means of a timing switch 270 operatively associated with the crankshaft of the loom (not shown) and provide the starting or timing pulse $T_o$ when the loom crankshaft is at front dead center, i.e. at 0°/360°, of its cycle. For this purpose, one can utilize a Hall effect switch mounted at the point on the periphery of the crankshaft corresponding to 0° rotation, the switch being activated by means of a magnetic element rotating bodily with the crankshaft. The structural details of timing switch 270 can be better understood, if necessary, by reference to a similar arrangement employed for opening and closing the solenoid clamp and shown in FIG. 37 of the drawings of the above-mentioned application Ser. No. 64,180. Thus, when the crankshaft is at its 0° position, the switch is closed to provide a positive output $T_o$. This output signal $T_o$ is momentarily delayed, say a few, e.g. 2 ms. by a time delay 272, the purpose of which is to allow this initiating pulse $T_o$ to be also used to reset various flip-flops in the circuit, as will be explained as the description proceeds. The briefly delayed timing pulse $T_o$ generated by switch 270 is delivered to the S input of a flip-flop 274 of the RS type which latches to hold at its output the timing pulse in stretched form as $T_{os}$ until the flip-flop is reset by application of a reset pulse to its reset input R. The output pulse $T_{os}$ from the flip-flop 274 is delivered to the input of each of the three-input gate included in the various sensing unit channels to initiate operation of each of such channels.

The first response to the delivery of timing pulse $T_{os}$ is the opening of the solenoid operated yarn clamp C, described above, which thereby readies the yarn delivery system of the loom for insertion of the length of yarn across the shed of the loom. The operation of the solenoid clamp C has already been described, and it will be recalled that when the clamp is energized for movement to its closed or clamping position, a switch 276, preferably a Hall effect switch associated with the plunger 115 of the solenoid is closed, providing a positive pulse indicative of the closed condition of the clamp. The yarn clamp is, of course, closed at the beginning of the cycle and does not open until before back dead center, say about 120°–130° of the cycle. Thus, at the beginning of the cycle switch 276 is closed, and a positive signal is thereby applied to the sensing input S of a three-input AND gate 278, which is continuously receiving clock signals at its input. When the timing signal $T_{os}$ is applied and held at its $T_{os}$ input, AND gate 278 delivers an output signal in synchronism with the clock signals to counter 280 and the cumulative count of the counter is displayed at display 282.

When during the cycle of the loom operation, the solenoid clamp is energized to open the yarn clamp, the solenoid clamp plunger 115 is moved to a position removing the Hall effect switch from the influence of the magnetic element so that the Hall effect switch opens. Thus, an output signal from the Hall effect switch is no longer applied to the S input of AND gate 278, and this gate, in effect, closes which prevents the continued transmission of the clock pulses via its input C to the counter 280 and on to be displayed at display 282. The counter, therefore, stops with the accumulated count existing at the moment of the opening of the solenoid clamp, and this accumulated count continues to be displayed on display 282.

It is also useful, and preferable, to provide a channel for indicating when the solenoid clamp returns to its closed position, at which the yarn is gripped and prevented from further advance into the shed, and to this end, the output signal from the yarn clamp switch 276 is also delivered to the input of a rising edge detector 284 incorporating a latch resettable by delivery of a resetting pulse at input R. As is known in the electronic art, a rising edge detector is designed to detect an increase or rise in a signal applied thereto and to provide an output pulse coinciding with the leading edge of that input signal, and the latch built into detector 284 holds that output until reset. The latched output from rising edge detector 284 is inverted at inverter 286 and delivered to the S input of AND gate 288, which has its output connected to a counter 290 with an associated display 292 adapted to receive and display the accumulated count of the counter.

The yarn clamp switch 270 provides a logic 0 output during the interval that the clamp is open and yarn can pass through the clamp for delivery to the loom and shifts to a logic 1 signal when the yarn clamp is closed at the end of that interval and in the absence of inverter 286, rising edge 284 would sense the beginning of such positive output and transmit a positive pulse from its output. The effect of inverter 286 is to reverse this relationship so that the normally logic 0 output of the edge detector is delivered as a continuous positive signal to the S input of AND gate 288; and when the leading edge of the positive pulse occurring upon clamp closure is sensed by the edge detector, the normally positive output response of the detector is inverted to a negative output for delivery to the S input of the AND gate. Therefore, as soon as the stretch timing signal $T_{os}$ is applied to the $T_{os}$ input of AND gate 288, that gate operates to transmit the clock pulses to counter 290 for display at display 292. However, when the output of the edge detector reverses incidental to clamp closure, a logic 0 signal is applied to the S input of AND gate 288 which ends the flow of clock pulses through that gate to counter 290 and holds the accumulated total as of that instant on a display 292.

As stated before, when the yarn clamp has been opened, the yarn is released for delivery from the stored supply, as described in more detail in application Ser. No. 64,180, under the propelling impetus of the yarn injection nozzle N. As already explained, when pressurized gas is supplied to the yarn insertion nozzle and the nozzle is "fired" so as to propel the yarn across the shed of the loom, a nozzle pressure sensor 300, preferably constituted by a "bimorph" crystal wafer exposed to the pressure existing in the throat of the nozzle, is activated and generates a positive output pulse signalling the moment of nozzle firing. This output pulse after appropriate amplification at amplifier 302 is delivered to a positive voltage level detector **304*p* which allows a positive voltage to pass above a certain preset level, say 2–3 volts, thereby shedding the channel from possible small size outputs or "noise" from the bimorph crystal wafer due to vibration or other extraneous circumstances. It is preferred that an indication be available for the moment in each cycle at which the nozzle throat pressure drops at the end of the flow of yearn propelling medium therefrom as well as the moment the nozzle throat pressure rises at the beginning of said flow; and, accordingly, the output from amplifier 302 is also delivered to a negative voltage level detector 304*n* set to detect a negative voltage above the same minimum of 2–3 volts similar to detector 304 but of opposite polarity. It will be recalled in this connection that the bimorph crystal emits a voltage of one polarity when deflected in one direction, as when the nozzle throat pressure rises, and a voltage of opposite polarity when deflected in the opposite direction, as when the nozzle throat pressure returns to ambient. Each of the level detectors delivers its output to a flip-flop 306*p*, 306*n*, which in turn delivers a corresponding output via an inverter 308*p*, 308*n* and thence to displays 314*p*, 314*n***.

Since the signal received by flip-flop **310*p* is previously inverted by inverter 308*p*, the S input of AND gate 310*p* receives a positive or logic 1 input signal during the time that the nozzle pressure sensor is inactive and is itself emitting a logic 0 signal. Consequently, when the $T_{os}$ input of the AND gate 310*p* becomes positive due to the application thereto of the stretched timing pulse $T_{os}$, the AND gate passes the clock pulses to the counter which begins counting those pulses while the display shows the accumulated total of such count. At the moment the nozzle pressure sensor 300 responds to firing of the nozzle by emitting a positive output pulse, that output is applied in inverted form as a negative signal to the S input of AND gate 310*p* and the counting of the counter is terminated with the accumulated count at that instant being maintained on display 314*p***.

Similarly, in the reactive state of the nozzle as well as during nozzle firing, negative level detector **304*n* emits a logic 0 output which after passage through the flip-flop 306*n* is inverted by inverter 308*n* and is applied, therefore, as a positive signal to the S input of flip-flop 310*n*. When the timing pulse $T_{os}$ is applied to the corresponding input of AND gate 310*n*, the AND gate transmits the clock pulses to the counter which begins counting, and the accumulated count is displayed at display 314*n*. When, however, the nozzle pressure falls to ambient at the end of nozzle firing, a logic 1 pulse is passed by the level detector to the flip-flop 306*n* which is inverted by the inverter 308*n* for application as a negative signal to the S input of AND gate 310*n*. This stops the counter 312*n* and holds the accumulated total at that instant on display 314*n***.

When all of the yarn coils W stored at the yarn supply D are withdrawn by the firing of the nozzle and delivered into the shed of the loom, the yarn tension sensor 320 incorporated in unit T is activated and gives a positive output pulse. This output pulse is amplified at amplifier 322 and delivered to a positive voltage level detector 324 which, as before, responds to give an output pulse of positive polarity only when an incoming positive voltage exceeds a certain minimum level. The responsiveness of the bimorph detector to mechanical stress means that the crystal can emit low level signals for reasons other than significant tensioning of the yarn, for example, machinery vibration, the shock of starting and stopping the loom, etc., and the object of the voltage detector is to filter out such extraneous noise and prevent any response of the corresponding channel other than that actually intended. In addition, when the nozzle N is fired to project the yarn, the inertia of the yarn to acceleration creates an initial peak and then as the yarn coils are unwound from the drum, random fluctuations in the tension of the moving yarn. Inasmuch as the yarn delivery sensor 320 is sensitive to any change in yarn tension within its operating capacity, the sensor will, as mentioned, emit output signals corresponding in magnitude to this initial peak and random tension fluctuations as indicated at x and y, respectively, in FIG. 20. Conceivably, the voltage level detector mentioned above could be effective to desensitize the channel to these random signals, but it is preferred to modify the circuit so as to more positively insure against extraneous operation. It has been observed that these random extraneous tension fluctuations occur during an identifiable part of the yarn delivery phase of the loom cycle which begins only with the opening of the yarn clamp as signalled by the yarn clamp switch 276. Thus, it becomes possible to inactivate the yarn delivery channel during that limited interval within which random tension fluctuations can take place in the yarn as it is being accelerated by the nozzle during insertion into the shed. To this end, the output of the yarn clamp 276 is also passed through a time delay element 328 which retards the ongoing passage of the signal for an appropriate time, say 10 or so ms. The duration of the delay created by the time delay 328 obviously must be selected following observation of the particular type of loom so as to continue as long as possible during the yarn delivery phase and thereby achieve maximum inactivation of the channel against the effect of random tension fluctuations during that phase, while nevertheless terminating definitely before the conclusion of that phase coincident with the complete withdrawal of the yarn supply which is signalled by the occurrence of peak tension.

The retarded yarn clamp switch signal is gated with the output signal from the level detector 324 at a two-input AND gate 330. The output from the yarn delivery sensor 320, is logic 0 until the peak tension occurs to generate a logic 1 pulse therefrom while the output of the yarn clamp switch 276 becomes logic 0 when the yarn clamp opens. AND gate 330 has its output connected to a flip-flop and the output of the flip-flop is in turn connected via an inverter 334 to the S input of a three-input AND gate 336. So long as both inputs to the AND gate 330 are at logic 0, the flip-flop will emit a logic 0 output which is inverted by inverter 334 and applied as a positive signal to the S input of AND gate 336. Hence, after the yarn clamp switch 276 has opened, with a consequential logic 0 output therefrom, and following the delay period of time delay 328, the flip-flop will become latched and hold a positive signal on the S input of gate 336. Assuming that the stretched timing pulse $T_{os}$ has already been applied to the corresponding input of gate 336 since the timing pulse normally will precede the opening of the yarn clamp switch 276, gate 336 will immediately begin transmission of the clock pulses to counter 338 and the counter stops with the accumulated count being displayed on display 340.

The yarn reception sensor 350 is, as described above, associated with the yarn reception tube at the side of the shed opposite to the yarn insertion nozzle. In the preferred improved form of this invention an array of light emitters-photocell receptors are arranged relative to the yarn path to generate a continuous positive output signal until the flow of light in that array is intercepted by the passage of the yarn thereacross. This output signal is inverted at inverter 351 and amplified to a workable level by amplifier 352 and delivered to a positive voltage level detector 354 functioning as before to filter out signals below a certain minimum positive voltage attributable to dust particles, for example, and thereby avoid the effect of extraneous background noise.

The output of the detector 354 is applied to a flip-flop 356, and the output from the flip-flop is first re-inverted at inverter 357 and then applied to the S input of a three-input gate 358, again having its other inputs receiving the clock pulse signals and the timing pulse $T_{os}$. Thus, as soon as the timing pulse $T_{os}$ is received and held at AND gate 358, a logic 1 state exists at all of its inputs, the sensor 350 normally emitting a logic 1 output which is in effect re-created at the AND gate S input by double inversion, and the gate passes the clock pulses to a counter 360 and its associated display 362. Assuming the yarn arrives normally in the receptor tube and is detected by the reception sensor 350, sensor 350 is interrupted and a momentary logic 0 signal is applied to the input of flip-flop 356 which switches to a logic 0 output and holds that zero output on the S input of AND gate 358, notwithstanding any possible resumption of a logic 1 output from the sensor 350. The loss of a logic 1 input at the S input of gate 358 terminates further passage of the signal to counter 360 which stops counting while the existing total count is held on display 362. On the other hand, if the yarn fails to arrive, counter 360 continues to count and to display its accumulated value on display 362.

If the yarn fails to arrive at the reception tube, the presumption is that a fault has occurred in the weaving operation, producing a defect in the fabric that requires immediate remedy and it is preferred that the present monitoring circuit be adapted to initiate in the event of nonreception of the yarn a control signal functioning to stop the loom as soon as possible. To this end, a further channel is added to the circuit to respond to a stop motion control switch 370 and activate the loom stop motion unless the reception of the yarn at the reception tube has been sensed and properly indicated. This stop motion control switch 370 is closed at an appropriate time late in each loom operating cycle, but just before front dead center, say at about 320°-330° of the cycle, and for this purpose a further Hall effect switch can be arranged on the periphery of the loom crankshaft so as to be closed at the proper point. Again, for structural details of one possible arrangement in this connection, reference may be had to related application Ser. No. 64,180. Closure of stop motion control switch 370 applies a positive signal to one input of a two-input gate 372 where it is gated with the inverted output signal of flip-flop 358 from the yarn reception channel. Unless and until yarn arrives at the reception sensor 350, the flip-flop 358 output (after inversion) will be at logic 1 and if this logic 1 state indicative of nonarrival of the yarn continues at one input of gate 372 up to the instant of the closure of the stop motion control switch 370, at that instant gate 372 will have a logic 1 at both its inputs and will deliver a positive output signal via a flip-flop 374 to the loom stop motion solenoid (not shown) to bring the loom to an immediate stop. In other words, if the yarn has not arrived at the reception tube at 320°-300° of the cycle, a defective pick is presumed to have occurred (since at that point, the shed is starting to close), and the circuit channel in question operates to "knock-off" the loom stop motion and prevent further weaving. On the other hand, if the yarn arrives properly, this event is manifested in a change of the output of flip-flop 372 to logic 0 which changed state will be held by the flip-flop until it is reset; consequently, the loom stop motion control circuit is disabled and the loom continues to operate for the next cycle.

It is necessary for each of the various counters, displays, and flip-flops or latches mentioned above (with two exceptions to be explained) to be reset at the beginning of each new cycle and while this can be achieved in various ways, the timing pulse $T_o$ can be effectively used to accomplish such resetting. Since as stated above, the basic function of the timing pulse is to begin each new monitoring cycle, obviously, the resetting action must at least slightly precede the beginning of each new cycle in order to clear the counters and displays of the accumulated count of the previous cycle and reset the flip-flop in preparation for the new cycle. It is for this reason that the timing pulse $T_o$ is very slightly delayed at the time delay element 272 before delivery to flip-flop 274 and transmission to all of the timing inputs $T_{os}$ of the several three-input AND gates identified above. If the loom has been already knocked off because of the nonreception of yarn at reception sensor 350, the resetting operation must be prevented to avoid wiping out the accumulated counts at the various channels and defeating the objective of the invention. In the present circuit, the reset action is disabled where the loom stop motion has already been activated by delivering the resetting pulse $T_o$ to a two-input AND gate 376 where it is gated with the output from the stop motion control flip-flop 374 after inversion of the latter at inverter 378. Hence, if the stop motion control flip-flop output is at logic 1 indicative of non-reception of the yarn, a logic 0 signal (because of inversion) is applied to gate 376 and prevents passage by that gate of the resetting signal. On the other hand, if the yarn has been received and sensed, stop motion control flip-flop 374 will be inverted to a zero logic output state, applying through inversion a positive signal to the input of gate 376 and as the resetting signal appears at the other input of this gate, the resetting signal is transmitted to all of the reset terminals R of the various counters, displays and flip-flops.

The two exceptions to the above behavior are the flip-flops 274 and 374, which are reset in a manner other than by the resetting pulse. In the case of flip-flop 374 forming a part of the loom stop motion channel, it is reset with a manual pushbutton 380 associated, for example, with the operating handle (not shown) of the loom so that after the defective pick has been remedied, restarting of the loom by the handle will also reset flip-flop 374. The timing signal flip-flop 274 is reset in a still different way; namely, by gating the signal from yarn reception flip-flop 356 before inversion with the output of stop motion control switch 370 through the two-input AND gate 380. If the yarn arrival has been indicated by sensor 350 at the time the stop motion switch 370 is closed, gate 380 will see a logic 1 at both its inputs and transmit a positive signal to the reset terminal R of timing signal flip-flop 274 to reset the same in readiness for the beginning of the next cycle. On the other hand, if no yarn has arrived by the time stop motion switch 370 is closed, the output from the reception sensor flip-flop 358 will remain at logic 0 and the timing pulse flip-flop 274 will remain latched. Therefore, even if a subsequent weaving cycle should occur after a defective cycle, due to mechanical inertia of the loom, the monitoring system will not be affected by the events of the subsequent cycle but instead will retain the displayed accumulated count for each of the monitored events that did transpire during the previous cycle and will continue to accumulate and display a count for any event which failed to occur due to the defective pick. In this way, the loom operator will be given an immediate indication of the probable cause of the defective pick so that that cause can be remedied in the simplest possible way.

The frequency of the clock pulses from generator 268 can be selected as desired but is preferably chosen at some useful multiple of tenths of a second. For example, if the clock pulse frequency is 1000 pulses/sec, the displays would read directly in milliseconds.

It will be appreciated that the readings of the various displays included in the overall monitoring system of the invention could be readily coordinated with a repair guide or handbook in the sense that the various combinations of display indications that would be conceivable or likely during the operation of the machine, on account of the common malfunctions arising during the operation of the looms in question, would be identified, for instance, in the form of typical pictorial illustrations of such combinations, and these identifications related to the probable cause of the malfunction leading to the pictured result and the procedures that would be calculated to remedy such malfunction. Obviously, the same general kind of coordination between result, cause and remedy could be accomplished in more sophisticated fashion by means of a computer which would be programmed to provide in response to the occurrence of predictable malfunctions as indicated by a particular sequence of display information, a printout or video display identifying the most probable cause or causes an the procedures that should be instituted to confirm the specific cause, in case there is more than one, plus the steps that should be followed by the loom attendant to remedy the particular malfunction and place the loom back into working condition.

It will also be understood that various alternatives are available for adopting the concept of the present invention for practical application to a loom. In one case, each loom could be equipped with a complete overall system including the various sensing units as well as the overall monitoring system itself with the associated counters and displays, etc. In this case, the operation of a thus-equipped loom would be monitored during all of its operating cycles so as to provide output indication immediately upon the occurrence of any loom malfunction. The performance of each such loom could, moreover, be recorded in a central station so as to collect pertinent operating information for all of the various looms housed in a given weave room of a textile plant and thereby identify any specific loom that exhibits an unusual susceptibility to malfunctions generally as well as specific kinds of malfunctions. However, the cost of equipping a number of looms with the entire system would be significant and an alternative approach would be to equip each individual loom with the various sensors alone and have their output lines connected to a multi-plug terminal at the loom, all of the components of the overall circuitry, exclusive of the sensing units themselves, being assembled into a portable housing having an input connection that could be plugged into the loom terminal when it is desired to check the performance of a particular malfunctioning loom. In the latter case, those looms which are performing normally with only rare malfunctions could be ignored, and any loom which exhibits an unusual number of malfunctions could then be plugged into the portable instrument and checked. In this way, a single overall circuit could effectively serve the needs of a considerable number of individual looms. Undoubtedly, other creative ways of taking practical advantage of the concept of the present invention will occur to the skilled worker in the art, and it is naturally intended that all of these various approaches would fall within the scope of the invention.

Finally, it should be remarked that although the individual sensing units have been conceived for utilization in association with one another and in association with the overall monitoring system described above, this association is not indispensable. Thus, the individual sensing units could be employed alone or in combination with other known types of sensing units or their output information could be used in a manner other than contemplated in the overall circuit described above; while on the other hand, the overall monitoring circuit itself is by no means dependent upon the particular preferred sensing units for the introduction therein of the contemplated operational information but could be equally well associated with other kinds of sensing units whether known or newly developed.

From these few possible variations in the practice of the invention, one will immediately perceive that the invention is not intended to be restricted to the specific embodiments selected for purposes of illustration and explanation but should be interpreted to encompass other modifications and variations possible in its construction and utilization within the skill of this art, and the invention should not, therefore, be limited in its scope except as required by the limitations of the appended claims.

What is claimed is:

1. In a cyclical method of weaving including in each cycle a weft insertion stage in which weft yarn is propelled from one side to the opposite side of the shed of a loom by means of a stream of pressurized fluid emitted from a nozzle while being simultaneously withdrawn from an accumulated supply at said one side substantially equal in length to the length of yarn to be inserted, the improvement of monitoring the performance of each weaving cycle by the steps of sensing the occurrence of a sequence of operating events during each cycle including an increase in pressure in the nozzle upon the emission of the fluid stream therefrom, the exhaustion of the accumulated yarn supply, and the arrival of the leading yarn end at the opposite shed side; simultaneously activating a plurality of timers corresponding to the plurality of functions so sensed at a common starting time in the weaving cycle prior to the weft insertion stage, terminating the operation of each counter only at the instant of the occurrence of the corresponding operating event being sensed while holding the elapsed time at such termination on each timer, and resetting said plurality of timers at the end of each cycle when the arrival of the yarn at the opposite shed side has been sensed.

2. The method of claim 1 including the step of preventing the resetting of said timers in the event the arrival of said yarn at said shed opposite side is not sensed.

3. The method of claim 1 including the step of generating a timing signal in synchronism with the loom cycle and activating said timers by means of said timing signal.

4. The method of claim 1 including the step of stopping the operation of the loom in the event the arrival of the yarn at said opposite shed side is not sensed intermediate said insertion stage and the beginning of the next loom cycle.

5. The method of claim 1 in which the yarn is positively clamped adjacent said one shed side at the end of each insertion stage and released at the beginning of the next insertion stage, and said sequence of operating events includes the step of sensing at least the opening of said clamp.

6. The method of claim 5 including the step of preventing the activation of the counter for said yarn supply exhaustion sensing step in the event the release of the yarn at the beginning of an insertion stage is not sensed.

7. The method of claim 6 wherein the counter for said yarn supply exhaustion sensing step is normally disabled from counting and including the step of deriving a control signal in response to the release of said yarn and enabling said counter for said yarn supply exhaustion sensing step with said control signal.

8. The method of claim 7 including the step of delaying said control signal for a predetermined period at the beginning of each insertion stage to prevent said yarn exhaustion counter from being prematurely activated.

* * * * *